US011666121B1

(12) United States Patent
Ben-Arie

(10) Patent No.: US 11,666,121 B1
(45) **Date of Patent: *Jun. 6, 2023**

(54) BUTTON FASTENING KIT II

(71) Applicant: Jezekiel Ben-Arie, Carlsbad, CA (US)

(72) Inventor: Jezekiel Ben-Arie, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/829,364

(22) Filed: Jun. 1, 2022

Related U.S. Application Data

(63) Continuation-in-part of application No. 17/562,042, filed on Dec. 27, 2021, now Pat. No. 11,375,776.

(51) Int. Cl.
*A44B 1/42* (2006.01)

(52) U.S. Cl.
CPC ..... *A44B 1/42* (2013.01)

(58) Field of Classification Search
CPC ..... A44B 1/28; A44B 1/42; A44B 17/0005; A44B 17/0035; A44B 17/0052; A44B 17/007
See application file for complete search history.

(56) References Cited

U.S. PATENT DOCUMENTS 1,277,595 A * 9/1918 Jaffe ..... A44B 1/34 24/108
3,623,192 A * 11/1971 Papazian ..... A44B 1/34 411/510
4,194,272 A * 3/1980 Taffurelli ..... A44B 1/34 411/510
4,662,034 A * 5/1987 Cunningham ..... A44B 1/28 24/94
5,107,573 A * 4/1992 Zhang ..... A44B 1/32 24/708
5,584,104 A * 12/1996 Stuart ..... A44B 1/185 24/104
6,702,162 B1 * 3/2004 Hassid ..... A41H 37/008 223/1
8,241,308 B2 * 8/2012 Kortenbach ..... A61B 17/068 606/220
8,522,404 B2 * 9/2013 Matei ..... A44B 1/28 24/104
9,861,167 B2 * 1/2018 Shirai ..... A44B 1/34
10,070,697 B1 * 9/2018 Melgoza ..... A44C 3/001
D842,165 S * 3/2019 Marin ..... D11/228
10,455,901 B2 * 10/2019 Marin ..... A44B 1/34
2010/0236029 A1 * 9/2010 Mattei ..... A44B 1/28 24/114.4
2019/0029370 A1 * 1/2019 Malvar ..... A44B 1/28

* cited by examiner

*Primary Examiner* — David M Upchurch

(57) ABSTRACT

The kit comprises a fastening structure and an anchoring structure. The fastening structure includes two vertical poles which are connected at their top ends by a horizontal bar and are inserted into two apertures of the button. The lower ends of the poles are attached to terminal elements. The anchoring structure comprises two trapping mechanisms which are configured to trap the terminal elements and to prevent them from detachment once they reach their trapping spots. The user places the fastening structure with the button above the cloth at the desired location and places the trapping mechanisms below the cloth opposite to the terminal elements. Next, the user pushes the poles downwards pierces the cloth and permanently traps the terminal elements by inserting them into the trapping mechanisms until they reach their trapping spots in which the resilient gates are released and occupy the cavities of the terminal elements.

8 Claims, 6 Drawing Sheets

BUTTON FASTENING KIT II

CROSS-REFERENCE TO RELATED APPLICATIONS

This Application is a continuation in part of application Ser. No. 17/562,042 filed on Dec. 27, 2021.

FEDERALLY SPONSORED RESEARCH

Not Applicable.

SEQUENCE LISTING OR PROGRAM

Not Applicable.

TECHNICAL FIELD

The present invention relates to Kits for Buttons Fastening to Garment Cloths.

PRIOR ART

Traditionally buttons are attached to garments by sewing threads. However, sewing buttons is quite slow and laborious. Furthermore, threaded buttons tend to detach and fall frequently. Most garment owners don't know how to refasten and sew fallen buttons. Hence, a Kit for simpler, faster and more robust button re-attachment could be quite useful and can yield a notable improvement. In our search we have found several inventions of button assemblies that were configured for fast button attachment but all of them are not designed for button reattachment. In addition, they are dissimilar to our invention both in their structures and in their principles of operation. Most, if not all of these attachment assemblies rely on some sort of metallic pedestal crimping in order to attach the button to the garment cloth. In U.S. Pat. No. 4,033,012 (Jul. 5, 1977) to Kramer et al. teaches a metallic button held by a metallic pedestal that is stapled to the garment cloth by a four legged metallic staple that is crimped to hold the pedestal. In U.S. Pat. No. 8,522,404 (Sep. 3, 2013) Matei teaches a button which can be tilted because it is attached to an elongated metallic shaft with ball attached at one end. The ball is housed in a ball bearing cavity included in the mounting base attached to the garment. In US 2005/0188510 (Sep. 1, 2005) Retamal teaches a button attached to an elongated serrated metal shaft which fits into a serrated metal nut attached to the garment. In U.S. Pat. No. 4,751,780 (Feb. 25, 1986) Fukuroi teaches a metal button which is attached to a mounting base by a crimped metal nail. In U.S. Pat. No. 4,512,063 (Apr. 23, 1985) Fukuroi teaches a metal button attachment to a base by a metal rivet. In U.S. Pat. No. 5,575,043 (Nov. 19, 1996) Candotti also teaches a metal button attachment to a base by a metal rivet. In U.S. Pat. No. 4,928,362 (May 29, 1990) Collas proposes to mount a metallic button on a metallic shank which is connected to a disk beneath the garment cloth. In U.S. Pat. No. 5,940,940 (Aug. 24, 1999) Tanikoshi teaches a button mounting by crimping a metal tubular rivet. In U.S. Pat. No. 5,975,398 (Nov. 2, 1999) Evans proposed attaching buttons to clothing by H shaped plastic studs which are inserted through the button holes into the clothing. In U.S. Pat. No. 9,820,520 (Nov. 21, 2017) Bolen teaches an attachment system with two parts one part attaches to the clothing side and the other part attaches to the button side and both parts are then coupled by a magnetic twist-lock mechanism. In U.S. Ser. No. 10/004,299 (Jun. 26, 2018) Maussen Teaches a tapered trapezoidal shape buttons which are connected to fabrics using sewing. IN U.S. Pat. No. 3,982,013 (Jul. 1, 1975) Gould teaches a button attachment using a rivet with long serrated shaft that protrudes from the clothing and is attached to a button with fitting aperture. In U.S. Pat. No. 8,938,861 (Jan. 27, 2015) McLendon teaches a removably attachable button using a pair of U-shaped flexible pins with small hooks at their ends, which are inserted through the clothing and through the buttonholes.

All the above inventions are entirely dissimilar to our invention.

BRIEF SUMMARY OF THE INVENTION

I have several goals in inventing and developing the Button Assembly kit of which some feasible embodiments are illustrated in FIGS. 1-11. The goals are:

1. To develop a Button Assembly Kit which facilitates easy manual attachment of the button to a garment cloth without any need for sewing, threads or metal crimping.
2. To design components of a Button assembly kit which facilitate robust manual Button fastening without needing additional tools or machines.
3. To configure a fastening structure which can be attached swiftly, firmly and permanently to cloths.
4. To design an anchoring structure (i.e. a structure which anchors the button to the cloth) which fastens the button to the cloth by trapping the fastening structure that is tied to the button.
5. To include trapping mechanisms in the anchoring structure which are configured to trap and hold the fastening structure.
6. To design trapping mechanisms which can withstand without detachment strong pulling forces when applied to the button.
7. To design a button assembly which could be manufactured inexpensively in mass production from common elastic materials such as plastics.
8. To configure an anchoring structure that includes a trapping mechanism which exploits the resiliency of gates made of materials such as plastics to trap a terminal element which is attached to the fastening structure. Thereby, robustly tying the button to the garment cloth.
9. To facilitate easy buttoning by configuring a fastening structure which includes Spacing Rings which introduce a buttoning gap between the button and the clothing.
10. To configure piercing cones which are temporarily attached to the bottom face of the terminal elements and facilitate piercing of the garment cloth during manual attachment of the fastening structure to the garment cloth.
11. To consider the option of drilling guiding apertures in the cloth in order to facilitate piercing of the cloth by the terminal elements during manual attachment of the fastening structure to the cloth.
12. To configure piercing cones which are temporarily attached to the bottom face of the terminal elements by narrow links which can be broken after the cones have been used for piercing. The narrow links are broken when the user applies manual pressure on the narrow links which presses them onto sharp wedges which are installed behind the narrow links.

In order to achieve the objectives listed above, our method for button fastening to the garment cloth is to tie the button to a fastening structure which includes at least two poles which are anchored to the cloth by an anchoring structure. In our approach, the bottom ends of the poles of the fastening structure are attached to terminal elements. The fastening of the button to the cloth is facilitated by trapping the terminal elements using trapping mechanisms housed at the anchoring structure which is placed beneath the cloth. The trapping mechanisms use resilient gating technique where the action of trapping is initiated by a forceful intrusion of the terminal elements each one into a separate trapping mechanism. Each trapping mechanism includes a resilient gate which is attached diagonally to the housing i.e. the left or the right anchoring apertures. The intrusion of a terminal element bends the diagonal resilient gate which resides inside the trapping mechanism which is housed in the anchoring structure beneath the cloth. When a terminal element is inserted into its trapping mechanism and reaches its trapping spot, the bent resilient gate is configured to unbend and be released into a cavity which is engraved into the terminal element. The released resilient gate which is stuck into the cavity traps the terminal element inside its trapping mechanism. The trapping mechanisms are designed to act in unisom. The cavities engraved at the terminal elements are configured to move in parallel such that all the cavities reach their trapping spots i.e. reaching below the tips of the maximally bended gates at the same instant. As an upshot, all the resilient gates unbend and are released into their corresponding cavities at the same instant. The released gates unbend due to their elasticity and turn inwards into their corresponding cavities thereby trapping the terminal elements which are tied to the button via the fastening structure. When the terminal elements attached to the ends of the poles of the fastening structure are pushed downwards into the anchoring structure apertures which house the trapping mechanisms, all the terminal elements attached to the poles of the fastening structure are simultaneously trapped. By which the button is fastened to the anchoring structure and to the cloth.

The fastening of the button to the garment cloth is performed as follows:

The button assembly is configured to be used for fast attachment of the button to the garment cloth by placing the anchoring structure below the garment cloth such that the anchoring structure's apertures are facing a lower side of the garment cloth while placing the fastening structure at an upper side of the garment cloth such that its attached terminal elements are situated opposite to the corresponding anchoring structure's apertures. Next, pushing downwards the fastening structure from the upper side of the garment cloth is configured to pierce the garment cloth by the lower sides of the terminal elements. Further pushing downwards inserts the terminal elements into the trapping mechanisms housed at the anchoring structure's apertures which are situated beneath the lower side of the garment cloth. Inserting the terminal elements downwards through the anchoring structure apertures is configured to bend the resilient gates and to trap the terminal elements within the trapping mechanisms inside the anchoring structure apertures when the terminal elements reach the trapping spots in which the resilient gates unbend and their tips are released into cavities which are engraved in the terminal elements. At the completion of the terminal element insertion, it is trapped inside the anchoring structure. At that point, the trapped terminal elements which are attached to the fastening structure, are configured to prevent detachment and separation of the fastening structure from the anchoring structure and from the garment cloth. Thereby, completing the attachment of the button to the garment cloth by permanently attaching the fastening structure to the garment cloth.

BRIEF DESCRIPTION OF THE DRAWINGS

FIG. 6 shows the fastening structure that already has been inserted into the button.

FIG. 7 shows the fastening structure that already has been inserted into the button and the spacing rings have been installed beneath the button.

FIG. 8 shows the fastening structure that already has been inserted into the button and already has been pierced the cloth while the spacing rings have been installed beneath the button and above the cloth.

FIG. 9 shows the fastening structure that already was inserted into the button and already pierced the cloth while the spacing rings were installed beneath the button and above the cloth. In FIG. 9 the fastening structure has been installed also in the anchoring structure's apertures and activated the trapping mechanisms as well. In FIG. 9 the piercing cones are still attached to the fastening structure.

FIG. 10 shows the fastening structure that already was inserted into the button and already pierced the cloth while the spacing rings were installed beneath the button and above the cloth. In FIG. 10 the fastening structure was installed also in the anchoring structure's apertures and activated the trapping mechanisms as well. In FIG. 10 the piercing cones are still attached to the fastening structure.

FIG. 11 shows the fastening structure that already was inserted into the button and already pierced the cloth while the spacing rings were installed beneath the button and above the cloth. In FIG. 11 the fastening structure was installed also in the anchoring structure's apertures and activated the trapping mechanisms as well. In FIG. 11 the piercing cones are removed from the fastening structure.

DETAILED DESCRIPTION OF THE DRAWINGS

Figure 1:
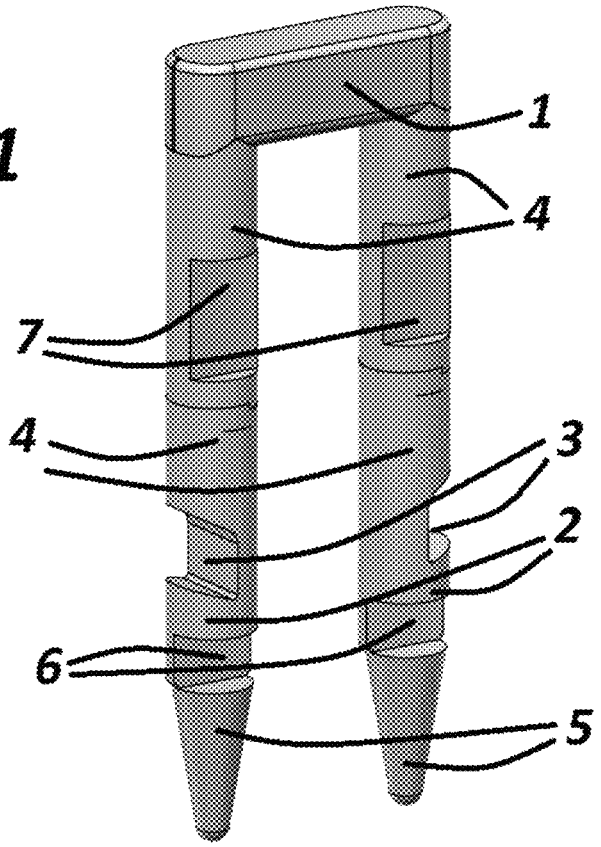
FIG. 1 displays a side view of an embodiment of the fastening structure in 3D isometric drawing.

FIG. 1 displays a side view of an embodiment of the fastening structure 1 in 3D isometric drawing. The two vertical poles 4 have mostly cylindrical shape. The vertical poles are attached at their top ends to a horizontal bar 1 which is used to engage the button 11 from above. At their bottom ends the poles 4 are attached to two terminal elements 2. The left element has an engraved cavity 3 with an opening facing towards the left whereas the right terminal element has an engraved cavity 3 with an opening facing towards the right. The bottom ends of the terminal elements 2 are attached to upper sides of the narrow links 6 which are attached at their bottom ends to upper obtuse ends of two cones 5 which have their pointed ends pointing downwards. The two flat engravings 7 at the sides of the poles were introduced in order to facilitate ejection of the poles 4 from the mold.

Figure 2:
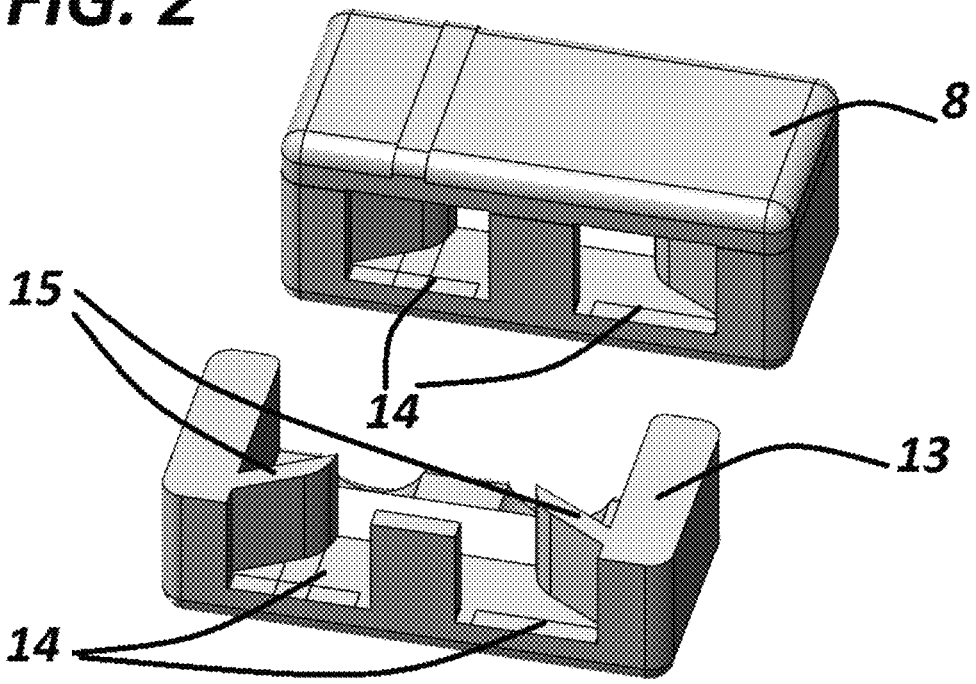
FIG. 2 Depicts in 3D isometric drawing a top view of an embodiment of the anchoring structure which includes two trapping mechanisms inside two apertures. A cross section of the anchoring structure is also displayed.

FIG. 2 Depicts in 3D isometric drawing a top view of an embodiment of the anchoring structure 8 which includes two trapping mechanisms inside two anchoring apertures. A cross section 13 of the anchoring structure is also displayed. Each of the anchoring apertures have an upper opening 14. Behind each of the upper openings there is a resilient gate 15 which is diagonally attached at its upper side to the walls of the anchoring structure. The lower side of each gate is unattached. The left gate is attached with a rightward diagonal orientation whereas the right gate is attached with a leftward diagonal orientation.

Figure 3:
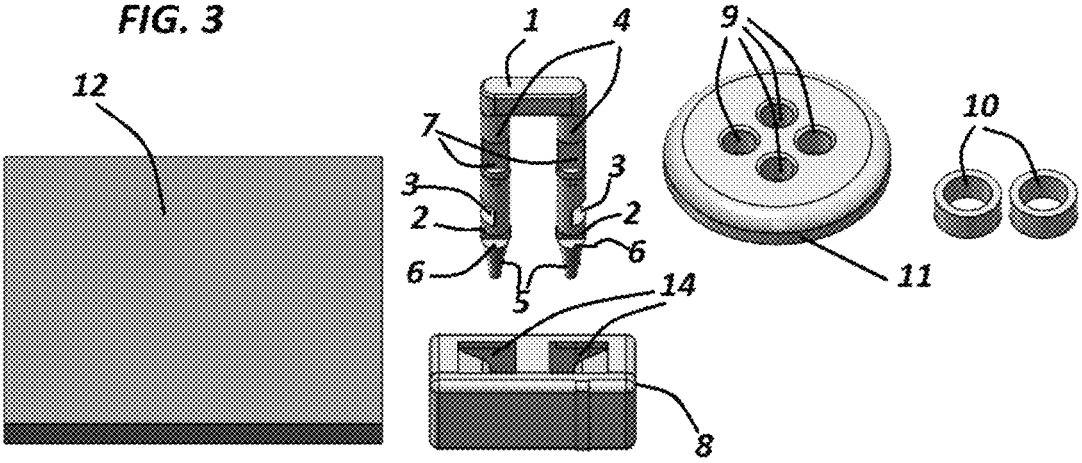
FIG. 3 Illustrates in 3D isometric drawing a top view of an embodiment of the all the components used in a button fastening to a cloth. This includes the fastening structure, the anchoring structure, the button, the spacing rings and a piece of cloth.

FIG. 3 Illustrates in 3D isometric drawing a top view of an embodiment which includes all the components used in a button fastening to a cloth. This includes the cross sections of the fastening structure 1, the anchoring structure 8, the button 11, the spacing rings 10 and a piece of cloth 12. The fastening structure's left and right poles 4 have a vertical orientation. The anchoring structure 8 is depicted below the fastening structure 1. The button 11 is lies horizontally on the right hand side of the fastening structure. As shown in FIG. 3 the button 11 has four apertures 9. The two spacing rings 10 are displayed on the right-hand side of the button 11 and the piece of cloth 12 is displayed on the left hand side.

Figure 4:
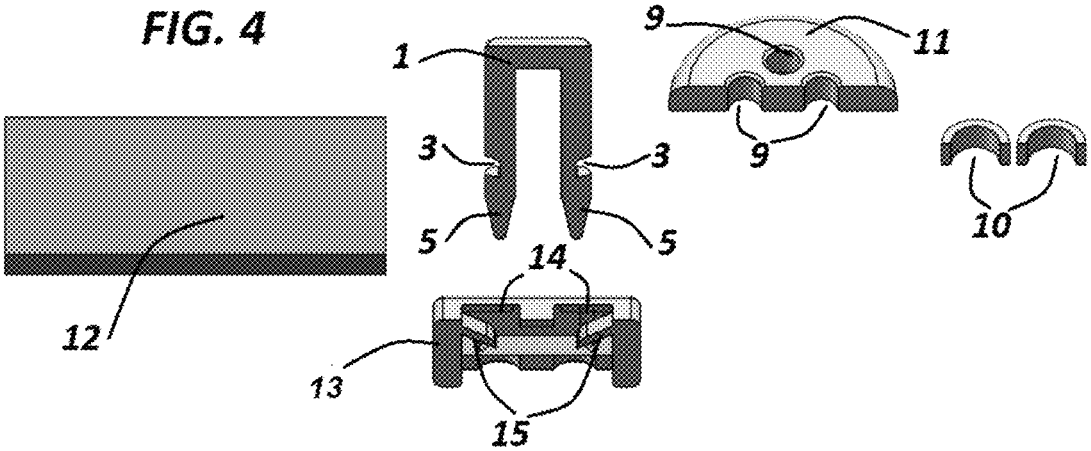
FIG. 4 illustrates in 3D isometric top view a cross sectional view of a collection of components required for a button fastening demonstration. The collection includes the cross sections of the fastening structure, the anchoring structure, the button, the spacing rings and the garment cloth.

FIG. 4 illustrates in 3D isometric top view a cross sectional view of a collection of components required for a button fastening demonstration. The collection includes the cross sections of the fastening structure 1, the anchoring structure 13, the button 11, the spacing rings 10 and the garment cloth 12. The fastening structure's left and right poles 4 have a vertical orientation and are connected on their top ends to the horizontal bar 1. The anchoring structure 13 is depicted below the fastening structure cones 5 which are attached to the bottom of the narrow links 6. The upper sides of the narrow links 6 are attached to the lower sides of the terminal elements 2 which are attached to the bottom of the poles 4. The button 11 is lies horizontally on the right hand side of the fastening structure 1. As shown in FIG. 3 the button 11 has four apertures 9. The two spacing rings 10 are displayed on the right-hand side of the button 11. The piece of cloth 12 is displayed at the left-hand side of the fastening structure 1.

Figure 5:
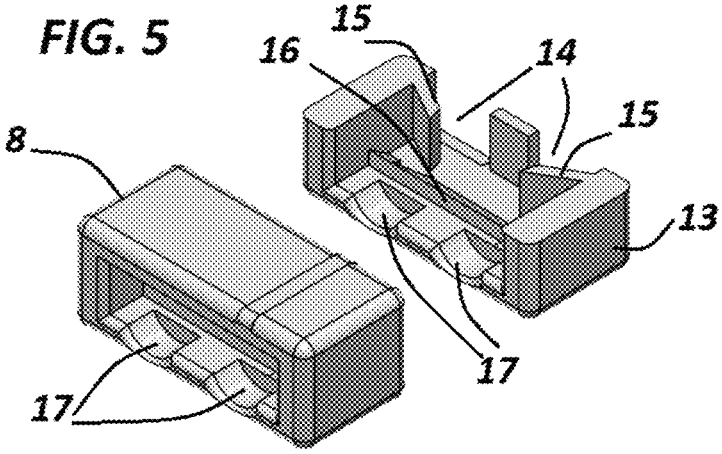
FIG. 5 Depicts in 3D isometric drawing a top view of an embodiment of the anchoring structure which includes two trapping mechanisms inside two anchoring apertures. A cross section of the anchoring structure is also displayed.

FIG. 5 Depicts in 3D isometric drawing a top view of an embodiment of the anchoring structure 8 which includes two trapping mechanisms inside two apertures. A cross section of the anchoring structure 13 is also displayed. The cross-sectional view of the anchoring structure 13 displays the two upper openings 14 and two resilient gates 15, which are diagonally attached to the walls of the anchoring structure 13. The sharp wedge 16 is situated behind the resilient gates 15 and are configured to facilitate breaking of the narrow link 6 when the user wants to disconnect the cones 5 from the fastening structure 1. The left anchoring aperture and the right anchoring aperture have depressions 17.

The left depression 17 is configured to facilitate breaking of the left narrow link 6 by providing a sufficient bending space for the right narrow link 6. The right depression 17 is configured to facilitate breaking of the right narrow link 6 by providing a sufficient bending space for the right narrow link 17.

Figure 6:
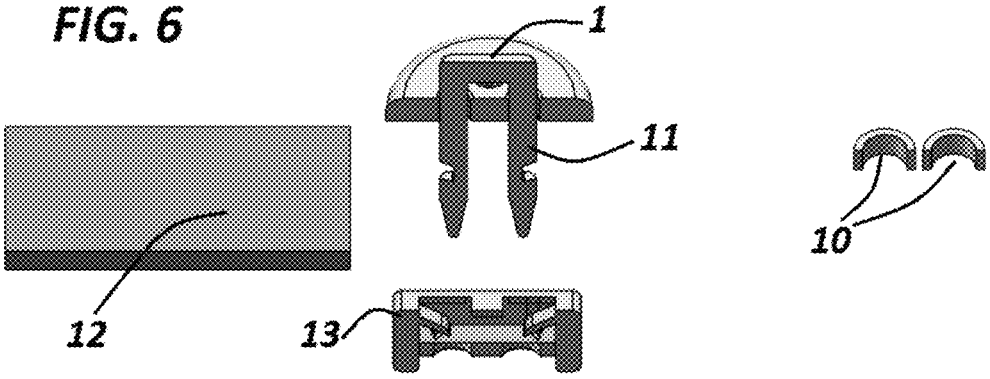
FIG. 6 illustrates in 3D isometric top view a cross sectional view of a collection of components required for a button fastening demonstration. The collection includes the cross sections of the fastening structure, the anchoring structure, the button, the spacing rings and the garment cloth.

FIG. 6 illustrates in 3D isometric top view a cross sectional view of a collection of components required for a button fastening demonstration. The collection includes the cross sections of the fastening structure 1, the anchoring structure 13, the button 11, the spacing rings 10 and the garment cloth 12. The fastening structure's left and right poles 4 have a vertical orientation and are connected at their top ends to the horizontal bar 1. A cross section of the anchoring structure 13 is depicted below the fastening structure cones 5 which are attached to the bottom to the bottoms of the narrow links 6. The upper sides of the narrow links 6 are attached to the terminal elements 2, which are attached to the bottom of the poles 4. The button 11 has been already installed at the top of the fastening structure poles 4. The poles 4 occupy 2 apertures 9 out of the button's four apertures 9. The two spacing rings 10 are displayed on the right-hand side of the button 11. The piece of cloth 12 is displayed at the left-hand side of the fastening structure 1.

Figure 7:
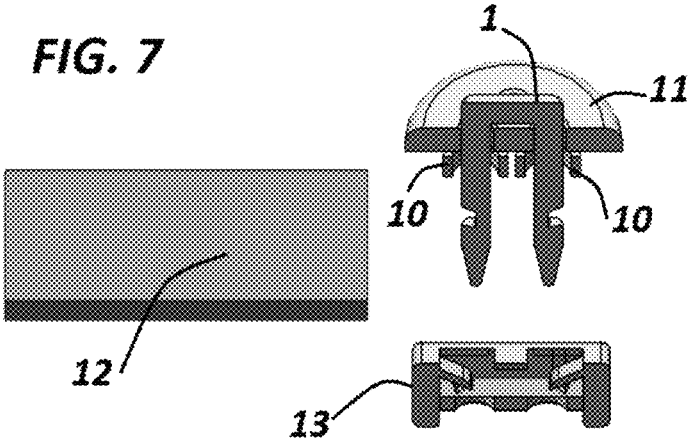
FIG. 7 illustrates in 3D isometric top view a cross sectional view of a collection of components required for a button fastening demonstration. The collection includes the cross sections of the fastening structure, the anchoring structure, the button, the spacing rings and the garment cloth.

FIG. 7 illustrates in 3D isometric top view a cross sectional view of a collection of components required for a button fastening demonstration. The collection includes the cross sections of the fastening structure 1, the anchoring structure 13, the button 11, the spacing rings 10 and the garment cloth 12. The fastening structure's left and right poles 4 have a vertical orientation and are connected at their top ends to the horizontal bar 1. The cross section of anchoring structure 13 is depicted below the fastening structure cones 5 which are attached to the bottom of the narrow links 6. The upper sides of the narrow links 6 are attached to the bottoms of the terminal elements 2, which are attached to the bottoms of the poles 4. The button 11 has been already installed at the top of the fastening structure poles 4. The poles 4 occupy 2 apertures 9 out of the button's four apertures 9. The two spacing rings 10 have been already installed on the poles 4 below the button 11. The piece of cloth 12 is displayed at the left-hand side of the fastening structure 1.

Figure 8:
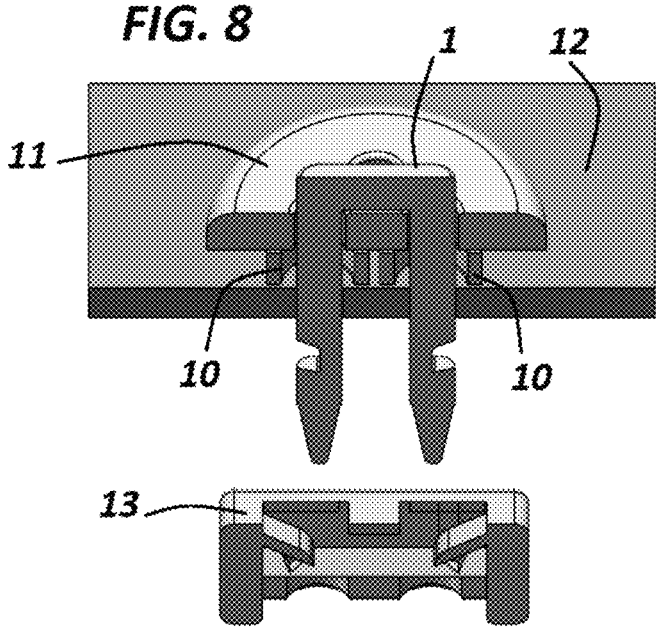
FIG. 8 illustrates in 3D isometric top view a cross sectional view of a collection of components required for a button fastening demonstration. The collection includes cross sections of the fastening structure, the anchoring structure, the button, the spacing rings and the garment cloth.

FIG. 8 illustrates in 3D isometric top view a cross sectional view of a collection of components required for a button fastening demonstration. The collection includes the cross sections of the fastening structure 1, the anchoring structure 13, the button 11, the spacing rings 10 and the garment cloth 12. The fastening structure's left and right poles 4 have a vertical orientation and are connected on their tops to the horizontal bar 1. The cross section of the anchoring structure 13 is depicted below the fastening structure cones 5 which are attached to the bottom of the narrow links 6. The upper sides of the narrow links 6 are attached to the bottom of the terminal elements 2, which are attached to the bottoms of the poles 4. The button 11 has been already installed at the top of the fastening structure poles 4. The poles 4 occupy 2 apertures 9 out of the button's four apertures 9. The two spacing rings 10 have been already installed on the poles 4 below the button 11. The piece of cloth 12 has been already pierced by the poles 4 and situated beneath the spacing rings 10.

Figure 9:
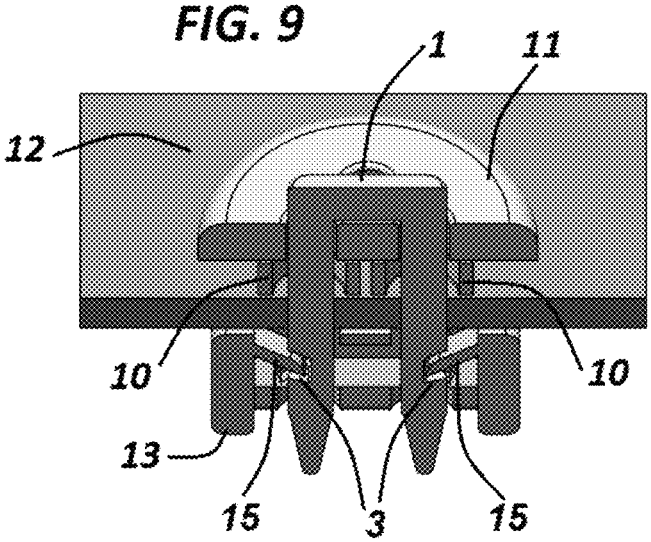
FIG. 9 illustrates in 3D isometric top view a cross sectional view of a collection of components required for a button fastening demonstration. The collection includes the cross sections of the fastening structure, the anchoring structure, the button, the spacing rings and the garment cloth.

FIG. 9 illustrates in 3D isometric top view a cross sectional view of a collection of components required for a button fastening demonstration. The collection includes the cross sections of the fastening structure 1, the anchoring structure 13, the button 11, the spacing rings 10 and the garment cloth 12. The fastening structure's left and right poles 4 have a vertical orientation and are connected on their tops to the horizontal bar 1. The cross section of the anchoring structure 13 is depicted below the fastening structure cones 5 which are attached to the bottom of the narrow links 6. The upper sides of the narrow links 6 are attached to the bottom of the terminal elements 2, which are attached to the bottoms of the poles 4. The button 11 has been already installed at the top of the fastening structure poles 4. The poles 4 occupy 2 apertures 9 out of the button's four apertures 9. The two spacing rings 10 have been already installed on the poles 4 below the button 11. The piece of cloth 12 has been already pierced by the poles 4 and situated beneath the spacing rings 10. The fastening structure 1 is already installed inside the anchoring structure 13. The two diagonal gates 15 inside the anchoring structure 13 are already trapping the fastening structure 1 by occupying the terminal elements' cavities 3.

Figure 10:
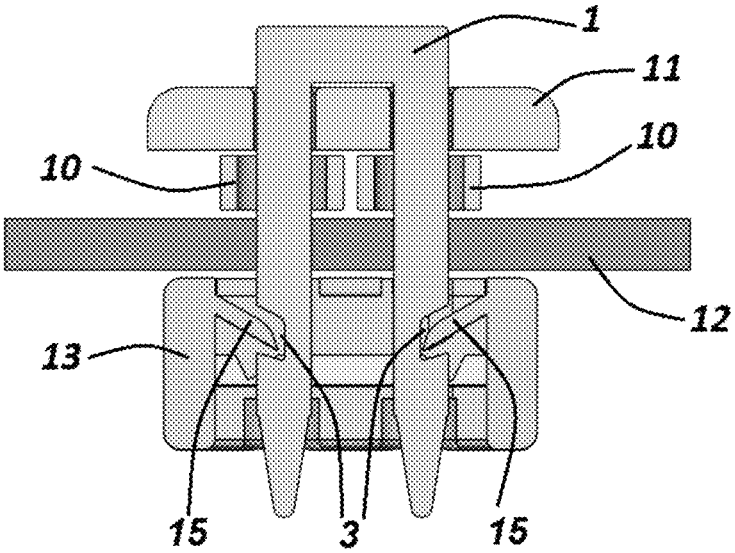
FIG. 10 illustrates in 3D isometric side view a cross sectional view of a collection of components required for a button fastening demonstration. The collection includes the cross sections of the fastening structure, the anchoring structure, the spacing rings and the garment cloth.

For better detail, FIG. 10 illustrates in 3D isometric side view of a cross sectional view of a collection of components required for a button fastening demonstration. The collection includes the cross sections of the fastening structure 1, the anchoring structure 13, the button 11, the spacing rings 10 and the garment cloth 12. The fastening structure's left and right poles 4 have a vertical orientation and are connected on their tops to the horizontal bar 1. The anchoring structure 13 is depicted below the fastening structure cones 5 which are attached to the bottom of the narrow links 6. The upper sides of the narrow links 6 are attached to the bottom of the terminal elements 2, which are attached to the bottoms of the poles 4. The button 11 has been already installed at the top of the fastening structure poles 4. The poles 4 occupy 2 apertures 9 out of the button's four apertures 9. The two spacing rings 10 have been already installed on the poles 4 below the button 11. The piece of cloth 12 has been already pierced by the poles 4 and situated beneath the spacing rings 10. The fastening structure 1 has been already installed inside the anchoring structure 13. The two diagonal gates 15 inside the anchoring structure 13 have been already trapping the fastening structure 1 by occupying the terminal elements' cavities 3.

Figure 11:
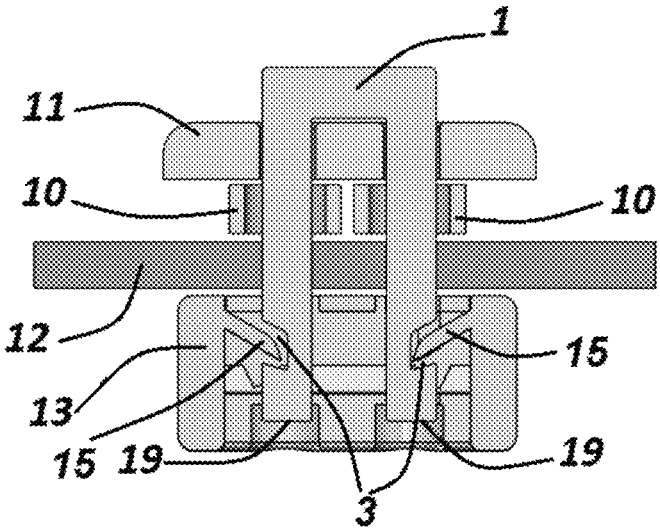
FIG. 11 illustrates in 3D isometric side view a cross sectional view of a collection of components required for a button fastening demonstration. The collection includes the cross sections of the fastening structure, the anchoring structure, the spacing rings and the garment cloth.

For better detail, FIG. 11 illustrates in 3D isometric side view of a cross sectional view of a collection of components required for a button fastening demonstration. The collection includes the cross sections of the fastening structure 1, the anchoring structure 13, the button 11, the spacing rings 10 and the garment cloth 12. The fastening structure's left and right poles 4 have a vertical orientation and are connected on their tops to the horizontal bar 1. The cross section of the anchoring structure 13 is depicted below the fastening structure cones 5 which are attached to the bottom of the narrow links 6. The upper sides of the narrow links 6 are attached to the bottom of the terminal elements 2, which are attached to the bottoms of the poles 4. The button 11 has been already installed at the top of the fastening structure poles 4. The poles 4 occupy 2 apertures 9 out of the button's four apertures 9. The two spacing rings 10 have been already installed on the poles 4 below the button 11. The piece of cloth 12 has been already pierced by the poles 4 and situated beneath the spacing rings 10. The fastening structure 1 has been already installed inside the anchoring structure 13. The two diagonal gates 15 inside the anchoring structure 13 has been already trapping the fastening structure 1 by occupying the terminal elements' cavities 3. In FIG. 11 the cones 5 were removed by breaking the narrow links 6 which connected the cones 5 to the terminal elements 2. The broken narrow links are denoted by 19.

What is claimed is:

1. A button assembly configured for a button fastening on a cloth;

wherein the button assembly comprises: the button, a fastening structure and an anchoring structure;

wherein the fastening structure comprising a left pole, a right pole, a horizontal bar, a left terminal element, a right terminal element, a left spacing ring, and a right spacing ring;

wherein the left terminal element includes a left cavity on top of a left terminal cylinder; wherein the left cavity has a left oriented opening;

wherein the right terminal element includes a right cavity on top of a right terminal cylinder; wherein the right cavity has a right oriented opening;

wherein the anchoring structure comprises a left trapping mechanism and a right trapping mechanism;

wherein the button is positioned horizontally and comprises a button's upper surface, a button's lower surface, a left buttoning aperture and a right buttoning aperture;

wherein the left pole is positioned vertically and configured to be inserted inside the left buttoning aperture;

wherein the right pole is positioned vertically and configured to be inserted inside the right buttoning aperture;

wherein a top end of the left pole is attached to a left end of the horizontal bar;

wherein a top end of the right pole is attached to a right end of the horizontal bar;

wherein the horizontal bar is positioned engaging above the button's upper surface;

wherein the left spacing ring is installed on the left pole engaging below the button's lower surface;

wherein the right spacing ring is installed on the right pole engaging below the button's lower surface;

wherein a left terminal element's upper side is attached to a bottom end of the left pole;

wherein a right terminal element's upper side is attached to a bottom end of the right pole;

wherein the left terminal element is tied to the button via the left pole which is attached to the horizontal bar;

wherein the right terminal element is tied to the button via the right pole which is attached to the horizontal bar;

wherein the cloth is placed and spread horizontally below the left terminal element and below the right terminal element;

wherein the left trapping mechanism is placed below the cloth and opposite to the left terminal element;

wherein the left trapping mechanism is configured to trap the left terminal element and prevent it from moving upwards when the left terminal element enters into the left trapping mechanism and reaches a left trapping spot;

wherein the right trapping mechanism is placed below the cloth and opposite to the right terminal element;

wherein the right trapping mechanism is configured to trap the right terminal element and prevent it from moving upwards when the right terminal element enters into the right trapping mechanism and reaches a right trapping spot;

wherein the left terminal element when pushed downwards, is configured to pierce the cloth and to enter into the left trapping mechanism and reach the left trapping spot;

wherein the right terminal element when pushed downwards, is configured to pierce the cloth and to enter into the right trapping mechanism and reach the right trapping spot;

wherein the button which is tied to the left terminal element and to the right terminal element is configured to be fastened on the cloth when the left terminal element and the right terminal element are pushed downwards and reach the left trapping spot and the right trapping spot respectively.

2. A button assembly of claim 1, wherein the anchoring structure comprises a left anchoring aperture and a right anchoring aperture;

wherein the left anchoring aperture houses the left trapping mechanism;

wherein the right anchoring aperture houses the right trapping mechanism;

wherein the left trapping mechanism is configured to trap the left terminal element inside the left anchoring aperture and to prevent it from moving upwards once the left trapping mechanism is activated; wherein the left trapping mechanism is activated when the left terminal element is inserted into the left trapping mechanism and reach the left trapping spot;

wherein the right trapping mechanism is configured to trap the right terminal element inside the right anchoring aperture and to prevent it from moving upwards once the right trapping mechanism is activated; wherein the right trapping mechanism is activated when the right terminal element is inserted into the right trapping mechanism and reach the right trapping spot;

wherein the button is configured to be fastened on the cloth by pushing simultaneously downwards the left pole and the right pole such that the left terminal element and the right terminal element move downwards and are configured to activate the left trapping mechanism and the right trapping mechanism respectively;

wherein when activated, the left terminal element and the right terminal element are configured to fasten the button to the anchoring structure and to the cloth.

3. The button assembly of claim 1, wherein a left pole's radius of a left pole's minimal bounding cylinder is equal to a left terminal element's radius of a left terminal element's minimal bounding cylinder;

wherein a right pole's radius of a right pole's minimal bounding cylinder is equal to a right terminal element's radius of a right terminal element's minimal bounding cylinder.

4. The button assembly of claim 1, wherein a left spacing ring's height equals a distance between a left spacing ring's upper side and a left spacing ring's lower side;

wherein a right spacing ring's height equals a distance between a right spacing ring's upper side and a right spacing ring's lower side;

wherein the left spacing ring's height and the right spacing ring's height are configured to be equal;

wherein the left spacing ring's height and the right spacing ring's height are equal to a buttoning spacing;

wherein the buttoning spacing is configured to be larger than a thickness of the cloth;

wherein a left spacing ring's aperture radius is configured to be larger than a radius of a left terminal element's minimal bounding cylinder;

wherein a right spacing ring's aperture radius is configured to be larger than a radius of a right terminal element's minimal bounding cylinder.

5. The button assembly of claim 4, wherein a height of a bounding cylinder of the left pole is greater than the sum of a thickness of the button, the buttoning spacing, the thickness of the cloth and a distance between the upper left opening and the left trapping spot;

wherein a height of a bounding cylinder of the right pole is greater than the sum of the thickness of the button, the buttoning spacing, the thickness of the cloth and a distance between the upper right opening and the right trapping spot.

6. The button assembly of claim 1, wherein a left guiding aperture and a right guiding aperture are drilled in the cloth; wherein the left guiding aperture is located opposite the left terminal element;

wherein the right guiding aperture is located opposite the right terminal element;

wherein the left guiding aperture is configured to facilitate piercing of the cloth by the left terminal element;

wherein the right guiding aperture is configured to facilitate piercing of the cloth by the right terminal element.

7. The button assembly of claim 1, wherein the anchoring structure comprises a left anchoring aperture and a right anchoring aperture;

wherein the left anchoring aperture houses the left trapping mechanism;

wherein the right anchoring aperture houses the right trapping mechanism;

wherein the left anchoring aperture includes an upper left opening;

wherein the right anchoring aperture includes an upper right opening;

wherein the left trapping mechanism includes a left gate, the left trapping spot, a left sharp wedge and a left narrow link;

wherein the left gate is made of a resilient material; wherein an upper side of the left gate is attached to the left anchoring aperture below the upper left opening and a lower end of the left gate is unattached; wherein the left gate is attached in a right leaning diagonal orientation;

wherein the left gate is configured to bend diagonally leftwards when pressed downwards by the left terminal element; while bending leftwards, the left gate is configured to facilitate a unidirectional downwards translation of the left terminal element via the upper left opening towards the left trapping spot; when the left terminal element reaches the left trapping spot, the left oriented opening is configured to reach the lower side of the left gate and the left gate is configured to be released, unbend and insert rightwards the lower side of the left gate into the left cavity; thereby trapping the left terminal element in the left trapping spot by the released lower side of the left gate;

wherein the right trapping mechanism includes a right gate, the right trapping spot, a right sharp wedge and a right narrow link;

wherein the right gate is made of resilient material; wherein an upper side of the right gate is attached to the right anchoring aperture below the upper right opening and a lower end of the right gate is unattached; wherein the right gate is attached in a left leaning diagonal orientation;

wherein the right gate is configured to bend diagonally rightwards when pressed downwards by the right terminal element; while bending rightwards the right gate is configured to facilitate a unidirectional downwards translation of the right terminal element via the upper right opening towards the right trapping spot;

when the right terminal element reaches the right trapping spot, the right oriented opening is configured to reach the lower side of the right gate and the right gate is configured to be released, unbend and insert leftwards the lower side of the right gate into the right cavity; thereby trapping the right terminal element in the right trapping spot by the released lower side of the right gate.

8. The button assembly of claim 7, wherein an upper side of the left narrow link is attached to a lower side of the left terminal element;

a left cone pointing downwards has a left obtuse upper end which is attached to a lower side of the left narrow link; the left sharp wedge has a left flat wedge basis which is attached to the left anchoring aperture behind the left narrow link;

the left anchoring aperture has a left depression below the left sharp wedge;

the left narrow link is configured to be broken when a user applies a manual pressure on the left cone which presses the left narrow link against the left sharp wedge;

the left depression is configured to facilitate breaking of the left narrow link by providing a sufficient bending space for the left narrow link;

the left cone is configured to facilitate piercing of the cloth by the left terminal element; following the piecing of the cloth, the left cone also facilitates entrance of the left terminal element into the left trapping mechanism;

wherein an upper side of the right narrow link is attached to a lower side of the right terminal element;

a right cone pointing downwards has a right obtuse upper end which is attached to a lower side of the right narrow link; the right sharp wedge has a right flat basis which is attached to the right anchoring aperture behind the right narrow link;

the right anchoring aperture has a right depression below the right sharp wedge;

the right narrow link is configured to be broken when the user applies the manual pressure on the right cone which presses the right narrow link against the right sharp wedge;

the right depression is configured to facilitate breaking of the right narrow link by providing a sufficient bending space for the right narrow link;

the right cone is configured to facilitate piercing of the cloth by the right terminal element; following the piecing of the cloth, the right cone also facilitates entrance of the right terminal element into the right trapping mechanism.

* * * * *